US009790042B2

(12) United States Patent
Iwasawa

(10) Patent No.: US 9,790,042 B2
(45) Date of Patent: Oct. 17, 2017

(54) SHEET CONVEYANCE APPARATUS AND IMAGE FORMING APPARATUS

(71) Applicant: CANON KABUSHIKI KAISHA, Tokyo (JP)

(72) Inventor: Ryo Iwasawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/174,046

(22) Filed: Jun. 6, 2016

(65) Prior Publication Data

US 2016/0362266 A1 Dec. 15, 2016

(30) Foreign Application Priority Data

Jun. 15, 2015 (JP) ..... 2015-120241

(51) Int. Cl.
*B65H 5/06* (2006.01)
*B65H 5/36* (2006.01)

(52) U.S. Cl.
CPC ..... *B65H 5/062* (2013.01); *B65H 5/36* (2013.01); *B65H 2402/521* (2013.01); *B65H 2402/522* (2013.01); *B65H 2404/133* (2013.01); *B65H 2404/17* (2013.01); *B65H 2404/6111* (2013.01)

(58) Field of Classification Search
CPC ..... B65H 5/06; B65H 5/062; B65H 29/125; B65H 2402/521; B65H 2402/522
See application file for complete search history.

(56) References Cited

U.S. PATENT DOCUMENTS

| | | | | |
|---|---|---|---|---|
| 6,769,683 | B2 | 8/2004 | Hiramatsu | |
| 2002/0135122 | A1 | 9/2002 | Hiramatsu | |
| 2005/0189701 | A1* | 9/2005 | Nagura | B65H 3/5261 271/167 |
| 2007/0000966 | A1* | 1/2007 | Tsusaka | B41J 13/03 226/101 |
| 2009/0166962 | A1* | 7/2009 | Osakabe | H04N 1/0057 271/264 |
| 2010/0264576 | A1* | 10/2010 | Tamehira | B65H 3/0684 271/10.11 |
| 2013/0285318 | A1* | 10/2013 | Yamaguchi | B41J 13/00 271/264 |
| 2015/0253718 | A1 | 9/2015 | Uchida et al. | |
| 2016/0289024 | A1* | 10/2016 | Morizono | B65H 5/062 |

FOREIGN PATENT DOCUMENTS

| | | | |
|---|---|---|---|
| JP | 2002-284389 | A | 10/2002 |
| JP | 2008-260631 | A | 10/2008 |

* cited by examiner

*Primary Examiner* — David H Bollinger
(74) *Attorney, Agent, or Firm* — Fitzpatrick, Cella, Harper & Scinto

(57) ABSTRACT

The sheet conveyance apparatus includes a frame supporting first and second bearing portions, and a restricting portion. The frame supports the first and second bearing portions such that a movable amount with respect to the frame, in a direction along a sheet conveying direction, of the first bearing portion is larger than that of the second bearing portion. The restricting portion is provided with a predetermined gap from the first bearing portion in the direction along the sheet conveying direction, and configured to restrict the first bearing portion from moving in the direction along the sheet conveying direction in a case when the first bearing portion abuts with the restricting portion.

17 Claims, 13 Drawing Sheets

SHEET CONVEYANCE APPARATUS AND IMAGE FORMING APPARATUS

BACKGROUND OF THE INVENTION

Field of the Invention

The present invention relates to a sheet conveyance apparatus conveying a sheet and more specifically to a configuration of a bearing supporting a shaft portion of a conveyance roller.

Description of the Related Art

Conventionally, a sheet conveyance apparatus applicable to an image forming apparatus such as a copier, a printer, a multi-function printer including copying and printing functions, and a facsimile and to an image reading apparatus includes a conveyance roller for delivering a sheet in a sheet conveying direction. Lately, the conveyance roller is often made of an inexpensive material and formed into a small size because it is demanded to downsize and to cut a cost of an entire apparatus.

If rigidity of a roller shaft of the conveyance roller drops by downsizing the conveyance roller, there is a possibility that the roller shaft deflects in a case when a relatively large pressure acts on the conveyance roller or on an approximately center part thereof in particular due to a pinch pressure caused with a conveyance driven roller opposing the conveyance roller. In order to prevent such deflection of the roller shaft, there is known a sheet conveyance apparatus including a conveyance roller in which two or more roller portions are provided around one roller shaft and supporting the roller shaft at three places of both end parts and a center part of the roller shaft to a frame by bearings as disclosed in Japanese Patent Application No. 2002-284389 for example. According to this sheet conveyance apparatus, it is possible to prevent the deflection of the roller shaft because the roller shaft is supported by the bearing also at the center part. It is noted that the roller shaft and the bearings of the conveyance roller are disposed basically coaxially. Each bearing is supported by the frame and supports the roller shaft rotatably with respect to the frame and immovably in a direction orthogonal to an axial direction.

However, because each bearing supports the roller shaft with respect to the frame immovably in the direction orthogonal to the axial direction in the sheet conveyance apparatus described above, there is a possibility of causing the following problems. That is, there is a case when the roller shaft of the conveyance roller has warpage and torsion in a longitudinal direction due to a variation of component accuracy. In this case, there is a possibility that the roller shaft is attached to the bearing coaxially disposed in an eccentric condition in which a center of the shaft is minutely deviated. If the conveyance roller is rotationally driven in the eccentric condition, rotational resistance and driving torque increase. Still further, there is a possibility of causing uneven slidability between the roller shaft and the bearing. If the driving torque increases, there is a possibility of needing to increase an output torque or size of a driving motor. Still further, if the uneven slidability is generated, there is a possibility of dropping sheet conveyance accuracy or of generating abnormal noise.

SUMMARY OF THE INVENTION

According to one aspect of the invention, a sheet conveyance apparatus includes a conveyance roller portion conveying a sheet, a roller shaft supporting the conveyance roller portion, a first bearing portion and a second bearing portion rotatably supporting the conveyance roller portion, a frame supporting the first bearing portion and the second bearing portion, the frame supporting the first bearing portion such that a movable amount with respect to the frame, in a direction along a sheet conveying direction, of the first bearing portion is larger than that of the second bearing portion, and a restricting portion provided with a predetermined gap from the first bearing portion in the direction along the sheet conveying direction for allowing the first bearing portion to move in a range of the predetermined gap, and configured to restrict the first bearing portion from moving in the direction along the sheet conveying direction in a case when the first bearing portion abuts with the restricting portion.

Further features of the present invention will become apparent from the following description of exemplary embodiments with reference to the attached drawings.

DESCRIPTION OF THE EMBODIMENTS

First Embodiment

A first embodiment of the present invention will be described in detail below with reference to FIGS. 1 through 9D. It is noted that while the present embodiment will be described by exemplifying a case when the present invention is applied to a laser beam printer, i.e., one example of an image forming apparatus 1, the present invention is not limited to be the laser beam printer and may be a different type image forming apparatus.

Figure 1:
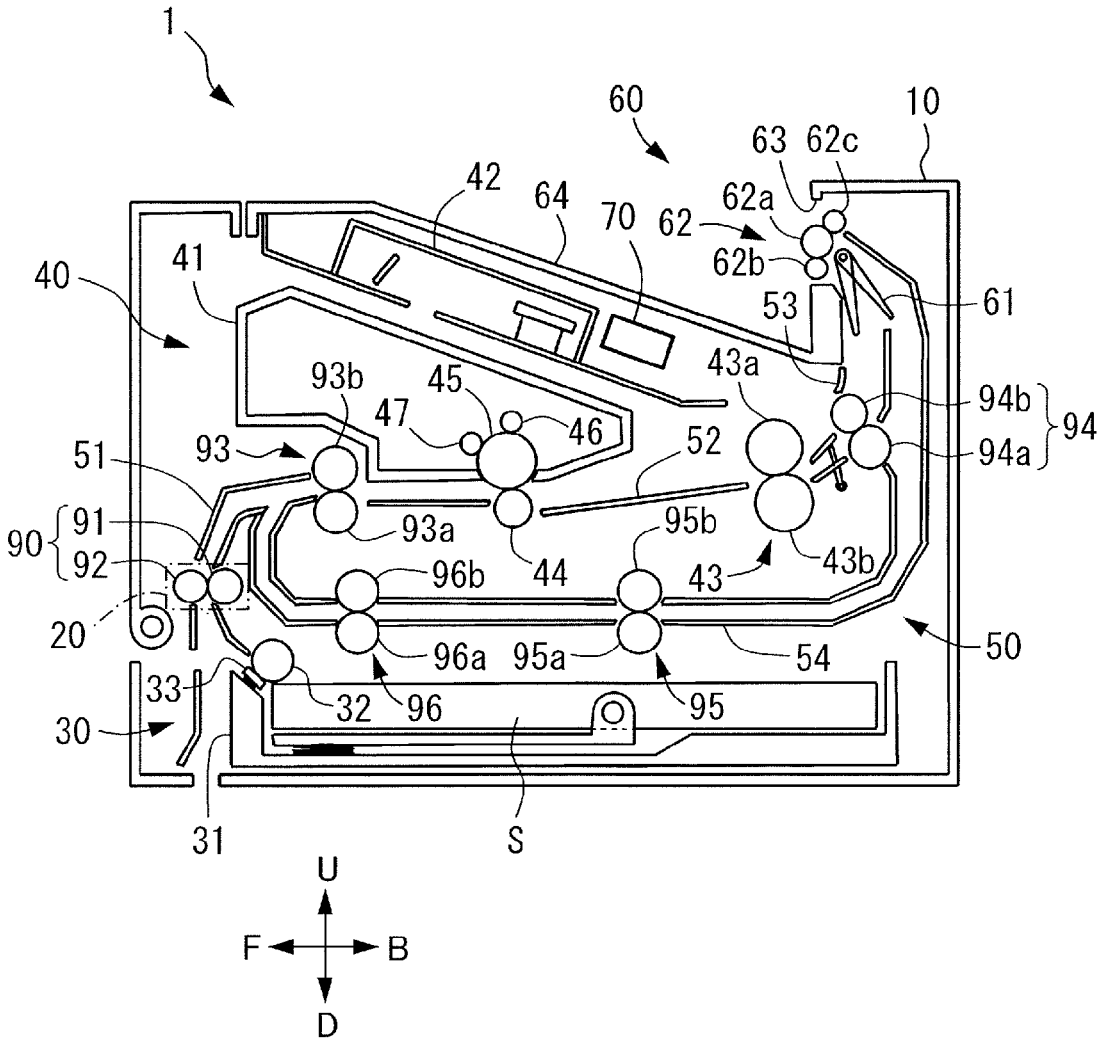
FIG. 1 is a schematic section view of an image forming apparatus of a first embodiment.

As illustrated in FIG. 1, the image forming apparatus 1 includes an apparatus body 10, a sheet feeding portion 30, an image forming portion 40, a sheet conveying portion 50, a sheet discharge and reversing portion 60, a control portion 70, and an operating portion (not shown). It is noted that a sheet S, i.e., a recording material, is a member on which a toner image is formed and is a plain sheet, a synthetic resin-made sheet as a substitute of the plain sheet, a thick sheet, or an overhead projector sheet. It is noted that in the present embodiment, a direction of a front side of the image forming apparatus 1 in which a sheet feed cassette 31 is drawn out of the apparatus will be denoted as a front direction F, a direction opposite the front direction F and in which the sheet feed cassette 31 is inserted into the apparatus will be denoted as a back direction B. In the same manner, upper, under, left, and right directions will be denoted respectively as an upper direction U, a lower direction D, a left direction L, and a right direction R.

The sheet feeding portion 30 is disposed at a lower part of the apparatus body 10 and includes the sheet feed cassette 31 stacking and storing the sheet S, a feed roller 32, and a separation pad 33. The sheet feeding portion 30 feeds the sheet S stacked in the sheet feed cassette 31 to the image forming portion 40 while separating one by one.

The image forming portion 40 includes an image forming unit 41, a toner bottle (not shown), an exposure unit 42, a fixing unit 43, and a transfer roller 44, and can form an image onto the sheet based on image information. The toner bottle is disposed above the image forming unit 41.

The image forming unit 41 includes a photosensitive drum 45, i.e., an image bearing member, capable of being in contact with the transfer roller 44, a charging roller 46, and a developing sleeve 47. Based on an image forming command given from the control portion 70 and the image information, the exposure unit 42 irradiates a surface of the photosensitive drum 45, which has been homogeneously electrified by the charging roller 46, with a laser beam. Thereby, an electrostatic latent image is formed on the surface of the photosensitive drum 45. Then, a toner image is formed on the surface of the photosensitive drum 45 by developing the electrostatic latent image by the developing sleeve 47. The toner image formed on the surface of the photosensitive drum 45 is transferred onto the sheet S sent by a registration roller pair 93 described later to a nip portion between the photosensitive drum 45 and the transfer roller 44. After that, the sheet S on which the toner image has been transferred is conveyed to the fixing unit 43.

The fixing unit 43 includes a heating roller 43*a* and a pressure roller 43*b*. The toner image that has been transferred onto the sheet S is heated and pressurized to be fixed onto the sheet S by being conveyed through a nip portion of the heating roller 43*a* and the pressure roller 43*b*.

The sheet conveying portion 50 includes a pre-transfer conveyance path 51, a pre-fixing conveyance path 52, a discharge conveyance path 53, and a re-conveyance path 54. The sheet conveying portion 50 is configured to convey the sheet S fed from the sheet feeding portion 30 to the image forming portion 40 and the sheet discharge and reversing portion 60.

A sheet conveyance apparatus 20 including a conveyance roller pair 90 and the registration roller pair 93 are provided along the pre-transfer conveyance path 51. The conveyance roller pair 90 is disposed downstream in a sheet conveying direction of the feed roller 32 and includes a conveyance roller portion 91 and a conveyance driven roller 92 being in contact with each other. The registration roller pair 93 is disposed downstream in the sheet conveying direction of the conveyance roller pair 90 and includes a registration roller 93*a* and a registration driven roller 93*b* being in contact with each other. The sheet S conveyed by the conveyance roller pair 90 is stopped once by the registration roller pair 93 to adjust position of the toner image formed on the photosensitive drum 45 with that of the sheet S. It is noted that the sheet conveyance apparatus 20 will be described in detail later.

A fixing conveyance roller pair 94 including a fixing conveyance roller 94*a* and a fixing conveyance driven roller 94*b* is provided along the discharge conveyance path 53. The sheet S that has passed through the fixing unit 43 is conveyed by the fixing conveyance roller pair 94 to the sheet discharge and reversing portion 60.

A duplex printing conveyance roller pair 95 including a duplex printing conveyance roller 95*a* and a duplex printing conveyance driven roller 95*b*, being in contact with each other, and a re-conveyance roller pair 96 including a re-conveyance roller 96*a* and a re-conveyance driven roller 96*b*, being in contact with each other, are provided along the re-conveying path 54.

The sheet discharge and reversing portion 60 is disposed downstream of the discharge conveyance path 53 and upstream of the re-conveying path 54 and includes a switching member 61 switching a conveyance path, a roller set 62, a discharge port 63 and a discharge tray 64 provided at an upper part of the apparatus body 10. The roller set 62 includes a driving roller 62*a* having discharge and reversing functions, a discharge driven roller 62*b*, and a reverse driven roller 62*c*. The sheet discharge and reversing portion 60 executes a discharge or reversing operation in accordance to an image forming command given from the control portion 70.

In executing the discharge operation, the sheet discharge and reversing portion 60 switches the switching member 61 to link the discharge conveyance path 53 with a nip portion between the driving roller 62*a* and the discharge driven roller 62*b* and rotates the driving roller 62*a* in a normal direction. Thereby, the sheet S is discharged by passing through the discharge port 63 between the driving roller 62*a* and the discharge driven roller 62*b* and is stacked on the discharge tray 64. In executing the reversing operation, the sheet discharge and reversing portion 60 switches the switching member 61 to link the discharge conveyance path 53 with a nip portion between the driving roller 62*a* and the reverse driven roller 62*c* and rotates the driving roller 62*a* in a reverse direction. Thereby, the sheet S is exposed to outside by passing through the discharge port 63 between the driving roller 62*a* and the reverse driven roller 62*c* and is conveyed to the re-conveying path 54 by switching the switching member 61 and by rotating the driving roller 62*a* in the normal direction. The re-conveyed sheet S passes again through the image forming portion 40, and an image is formed on a second surface of the sheet S similarly to a first surface thereof. After that, the sheet S is discharged by the sheet discharge and reversing portion 60 and is stacked on the discharge tray 64.

The control portion 70 is composed of a computer and includes, for instance, a CPU, a ROM storing a program controlling each portion, a RAM temporarily storing data, an input/output circuit (I/F) inputting/outputting signals with the outside, none of which are illustrated. The CPU is a microprocessor managing entire controls of the image forming apparatus 1 and is a main body of a system controller. The CPU is connected with the sheet feeding portion 30, the image forming portion 40, the sheet conveying portion 50, the sheet discharge and reversing portion 60, and the operating portion through the input/output circuit to exchange signals with and controls operations of the respective portions. Still further, the control portion 70 is enabled to be operated or set by a user through an instruction given from a computer (not shown) connected with the apparatus body 10 or by operating the operating portion.

Next, an image forming operation of the image forming apparatus 1 constructed as described above will be described.

With a start of the image forming operation, the exposure unit 42 emits a laser beam based on image information to form an electrostatic latent image on the surface of the photosensitive drum 45. The electrostatic latent image is developed by toner adhering on the image and is visualized as a toner image. At this time, the greater a potential difference, i.e., a difference between an exposure amount and a bias applied to the developing sleeve 47, the more a developed toner amount increases.

Meanwhile, in parallel with such toner image forming operation as described above, the feed roller 32 is rotated to feed an uppermost sheet S in the sheet cassette 31 while separating one by one. Then, the sheet S is conveyed to the photosensitive drum 45 through the pre-transfer conveyance path by adjusting timing with the toner image on the photosensitive drum 45. Still further, the image is transferred from the photosensitive drum 45 onto the sheet S. The sheet S is then conveyed to the fixing unit 43 to heat and press, i.e., to fix, the unfixed toner image onto the surface of the sheet S. The sheet S is then discharged by the roller set 62 and is stacked on the discharge tray 64.

Next, an outline of the sheet conveyance apparatus 20 of the image forming apparatus 1 described above will be described with reference to FIGS. 2A through 4A. It is noted that in the sheet conveyance apparatus 20 here, the sheet conveying direction orients the upper direction U, and a direction in parallel with the sheet conveying direction is a vertical direction. Still further, a direction perpendicular to a sheet conveying surface will be denoted as a front-back direction.

Figure 2A:
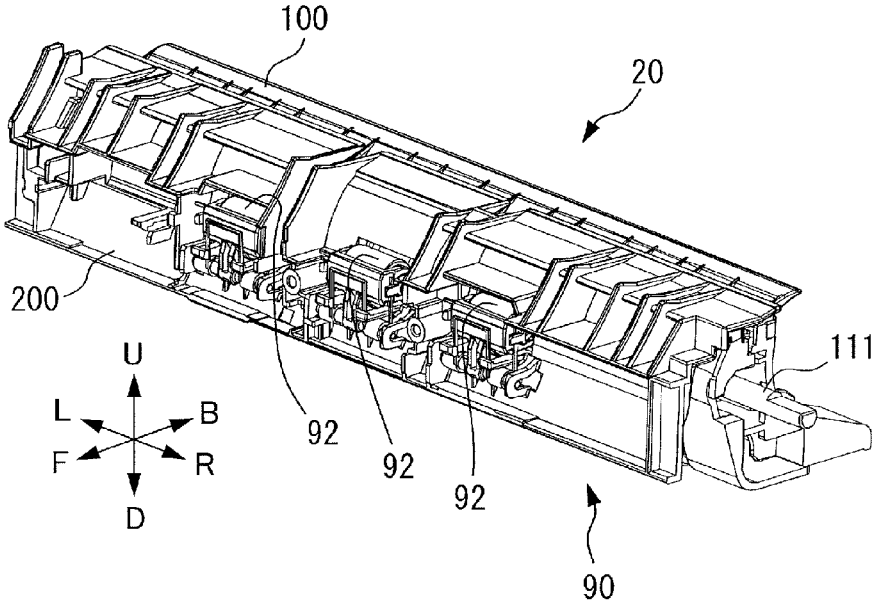
FIG. 2A is a perspective view illustrating a sheet conveyance apparatus of the first embodiment.
Figure 2B:
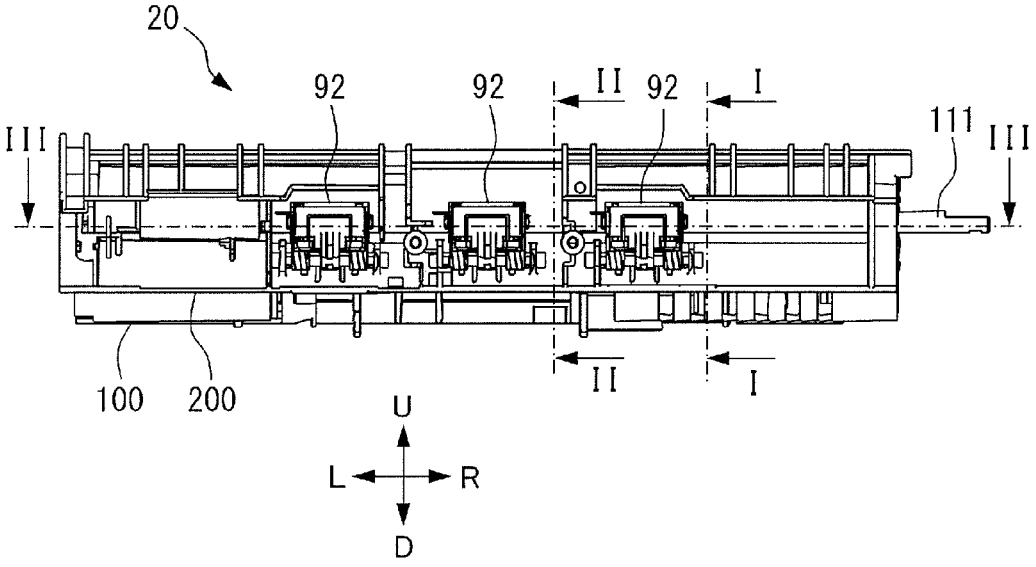
FIG. 2B is a front view illustrating the sheet conveyance apparatus of the first embodiment.

As illustrated in FIGS. 2A and 2B, the sheet conveyance apparatus 20 includes a conveyance roller side unit 100 and a conveyance driven roller side unit 200. The conveyance roller side unit 100 is attached to a frame (not shown) of the apparatus body 10. The conveyance driven roller side unit 200 is attached to the conveyance roller side unit 100. The sheet conveyance apparatus 20 also includes a conveyance roller pair 90, and a conveyance roller portion 91 and a roller shaft are provided in the conveyance roller side unit 100, and a conveyance driven roller 92 is provided in the conveyance driven roller side unit 200, respectively.

Figure 3A:
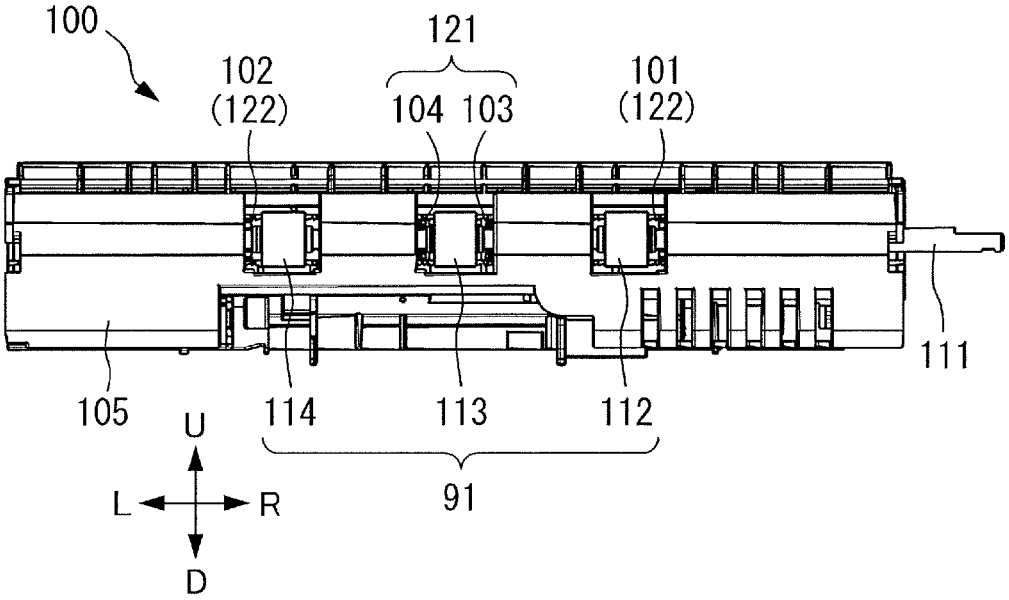
FIG. 3A is a front view of a conveyance roller side unit illustrating a part of the sheet conveyance apparatus of the first embodiment.

As illustrated in FIG. 3A, the conveyance roller side unit 100 includes the conveyance roller portion 91, the roller shaft 111, a first bearing portion 121, a second bearing portion 122 and a conveyance roller side frame (frame) 105. The first bearing portion 121 comprises the third bearing 103 and the fourth bearing 104. The second bearing portion 122 comprises the first bearing 101 and the second bearing 102. That is, the conveyance roller side unit 100 includes at least three bearings rotatably supporting the roller shaft 111 to support the conveyance roller portion 91. In the present embodiment, at least one bearing comprises at least two bearings, and the at least two bearings are the third and fourth bearings 103 and 104. Still further, at least two bearings are provided as the other bearings. That is, the other bearings are the first and second bearings 101 and 102 in the present embodiment.

The conveyance roller portion 91 is provided to convey the sheet S and includes at least two rollers in the present embodiment. The conveyance roller portion 91 includes a first roller 112, a second roller 113, and a third roller 114 in the present embodiment (see FIG. 7A). The first, second, and third rollers 112, 113, and 114 are made of rubber for example, are press-fitted respectively around the roller shaft 111, and rotate together when the roller shaft 111 is rotationally driven. It is noted that the roller shaft 111 is composed of a molding material for example and is formed such that its stiffness is weaker than a conveyance roller side frame 105 described later.

Figure 4A:
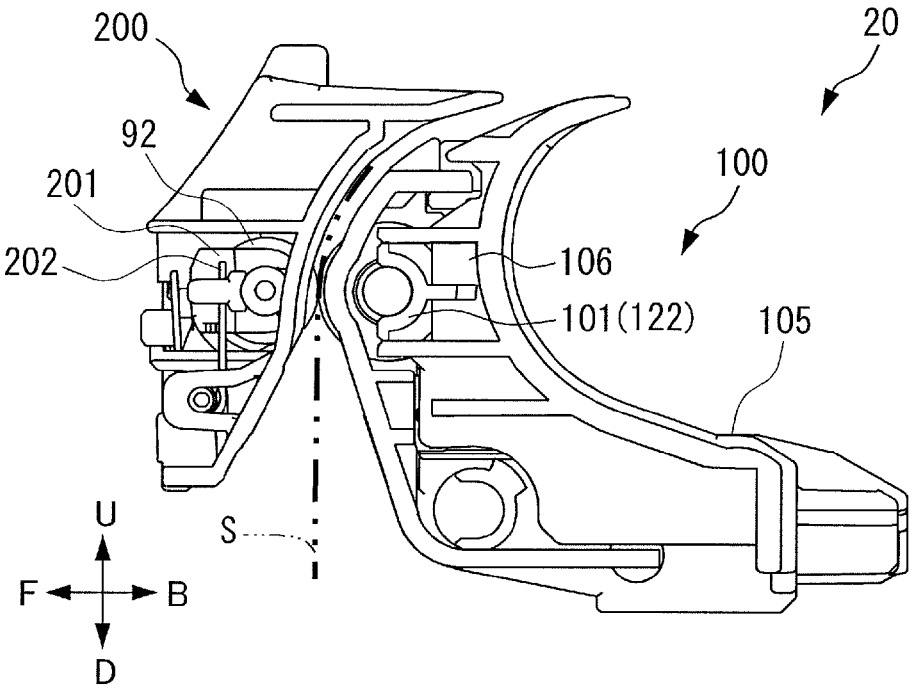
FIG. 4A is an overall section view illustrating a state in which the sheet conveyance apparatus of the first embodiment is cut at a line I-I in FIG. 2B.
Figure 4B:
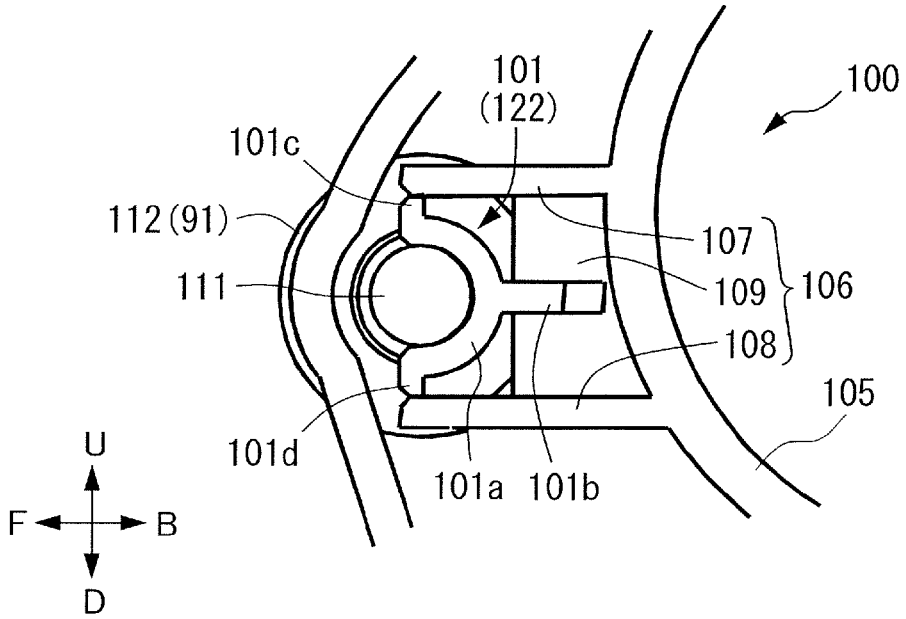
FIG. 4B is a partially enlarged section view illustrating the state in which the sheet conveyance apparatus of the first embodiment is cut at the line I-I in FIG. 2B.

The first, second, third, and fourth bearings 101, 102, 103, and 104 are attached to the conveyance roller side frame 105 and rotatably support the conveyance roller portion 91 by being in contact with an approximately semi-circumferential surface on the back direction B side of the roller shaft 111 (see FIG. 4B). The first bearing 101 is disposed in the vicinity of an outside (on the right direction R side) of the first roller 112. The second bearing 102 is disposed in the vicinity of an outside (on the left direction L side) of the third roller 114. The third bearing 103 is disposed in the vicinity of the right direction R side of the second roller 113. The fourth bearing 104 is disposed in the vicinity on the left direction L side of the second roller 113. That is, the third and fourth bearings 103 and 104 are disposed between the first and second bearings 101 and 102.

Figure 3B:
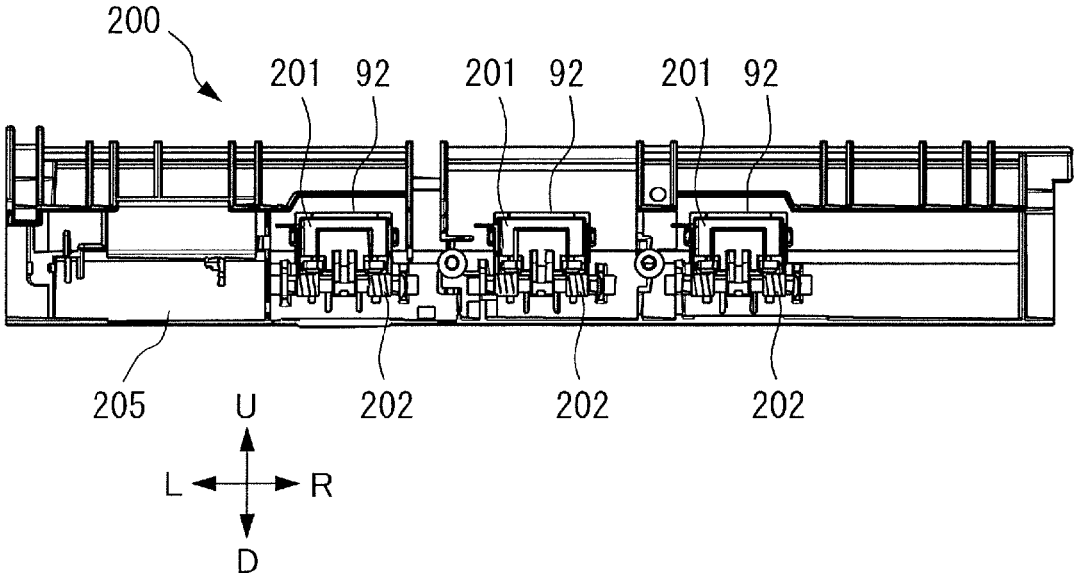
FIG. 3B is a front view of a conveyance driven roller side unit illustrating a part of the sheet conveyance apparatus of the first embodiment.

As illustrated in FIG. 3B, the conveyance driven roller side unit 200 includes a conveyance driven roller 92, a conveyance driven roller holder 201, a conveyance driven roller spring 202, and a conveyance driven roller side frame 205. In the present embodiment, the conveyance driven rollers 92 are disposed coaxially and at three places facing the three rollers 112, 113, and 114 of the conveyance roller portion 91. Each of the conveyance driven roller 92 is provided with the conveyance driven roller holder 201 and the conveyance driven roller spring 202 separately. The conveyance driven roller 92 is rotatably supported by the conveyance driven roller holder 201, and the conveyance driven roller holder 201 is swingably supported by the conveyance driven roller side frame 205. The conveyance driven roller spring 202 includes two torsion coil portions and is attached to the conveyance driven roller holder 201.

When the conveyance driven roller side unit 200 is assembled to the conveyance roller side unit 100, the conveyance driven roller 92 abuts with the rollers 112, 113, and 114 facing with each other as shown in FIG. 4A. Then, the conveyance driven roller 92 is pressed in the front direction F side through the conveyance driven roller holder 201 against the conveyance driven roller spring 202. Simultaneously with that, a reaction force from the conveyance driven roller 92 acts on the conveyance roller portion 91 in the back direction B. That is, the conveyance driven roller 92 presses the conveyance roller portion 91 to the conveyance roller side unit 100 in a direction vertical to the sheet conveying surface.

In forming an image by the image forming apparatus 1, the roller shaft and the conveyance roller portion 91 are rotated at a predetermined timing by being driven by a motor (not shown). At this time, the conveyance driven roller 92 being pressed by the conveyance driven roller spring 202 rotates in synchronism by friction with the conveyance roller portion 91. After that, the sheet S is conveyed from the sheet feeding portion 30 at a predetermined timing and is pinched by the nip portion of the conveyance roller portion 91 and the conveyance driven roller 92. Upon rotation of the conveyance roller portion 91, the sheet S is conveyed downstream.

Next, a configuration of each bearing of the sheet conveyance apparatus 20 in the image forming apparatus 1 described above will be described in detail with reference to FIGS. 4A through 6.

At first, configurations of the conveyance roller side frame 105 and the first bearing 101 will be described with reference to FIGS. 4A and 4B. It is noted that the second bearing 102 also has the same configuration with the first bearing 101. As illustrated in FIG. 4A, the conveyance roller side frame 105 includes a number of ribs 106 projecting out in the front direction F side. Then, as illustrated in FIG. 4B, the rib 106 around the first bearing 101 includes an upper restricting portion 107, a lower restricting portion 108, and a back restricting portion 109. It is noted that while the conveyance driven roller side unit 200 is not illustrated in FIG. 4B, actually the conveyance driven roller side unit 200 is provided and the conveyance driven rollers 92 abut against and presses the respective rollers 112, 113, and 114 in the back direction B.

The upper restricting portion 107 is disposed at the upper direction U side of the first bearing 101 and abuts with the first bearing 101 to restrict the first bearing 101 from moving upward. The lower restricting portion 108 is disposed at the lower direction D side of the first bearing 101 and abuts with the first bearing 101 to restrict the first bearing 101 from moving downward. The back restricting portion 109 is disposed at the back direction B side of the first bearing 101 to restrict the first bearing 101 from moving to the back side and in a horizontal direction of the first bearing 101.

The first bearing 101 includes a bearing portion 101*a* formed into an approximately semi-circular arc in section that orients in the front direction F, a holding portion 101*b* projecting to the back direction B side from the bearing portion 101*a*, an upper abutment portion 101*c*, and a lower abutment portion 101*d*. An inner circumferential surface of the bearing portion 101*a* is an approximately semi-circumferential surface and rotatably supports the roller shaft 111 of the conveyance roller portion 91. The holding portion 101*b* projects in the back direction B so as to bifurcate from the bearing portion 101*a* as a base end in the horizontal direction and such that the back restricting portion 109 of the rib 106 is clamped and held between the bifurcated holding portions 101*b* (see FIG. 6). In this state, the holding portion 101*b* is restricted from moving in the horizontal direction and in the back direction by the back restricting portion 109 and is not restricted from moving in the vertical direction by the back restricting portion 109. The upper abutment portion 101*c* always abuts with the upper restricting portion 107 from underneath, and the lower abutment portion 101*d* always abuts with the lower restricting portion 108 from above.

Therefore, the first bearing 101 is restricted from moving in the horizontal direction by the abutment of the holding portion 101*b* and the back restricting portion 109, is restricted from moving in the upper direction U by the upper restricting portion 107, and is restricted from moving in the lower direction D by the lower restricting portion 108. That is, the first and second bearings 101 and 102 are fixed vertically to the conveyance roller side unit 100 and are almost immovably supported by the conveyance roller side frame 105. Still further, when the conveyance driven roller side unit 200 is assembled to the conveyance roller side unit 100, the first roller 112 is pressed in the back direction B by the conveyance driven roller 92 and the first bearing 101 is pressed in the back direction B by the roller shaft 111. Therefore, the base end part of the holding portion 101*b* is brought into contact with a front end surface of the back restricting portion 109, and the first bearing 101 is restricted from moving in the front-back direction.

Figure 5A:
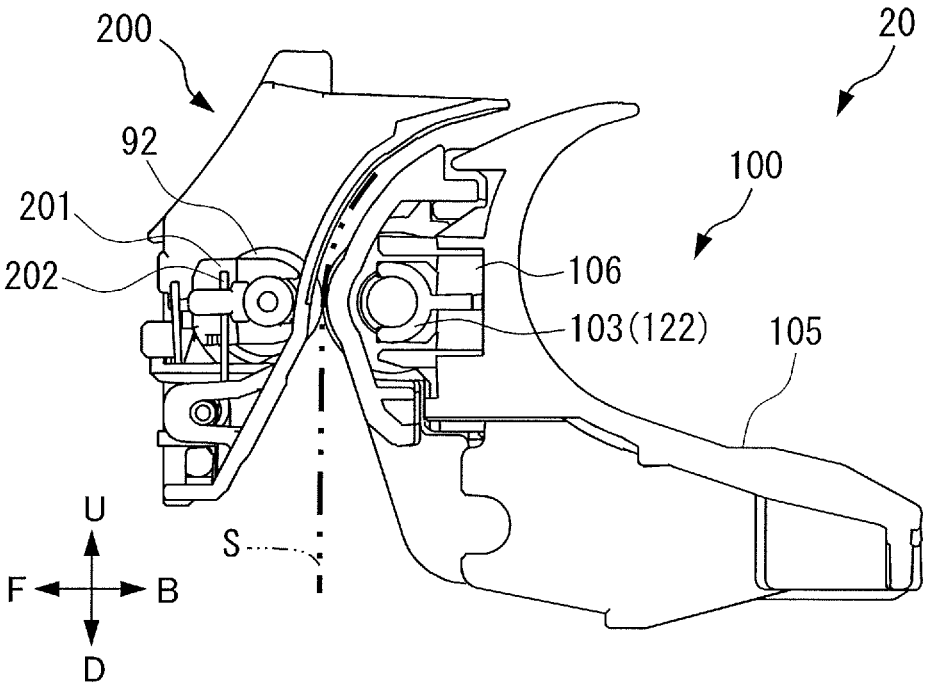
FIG. 5A is an overall section view illustrating a state in which the sheet conveyance apparatus of the first embodiment is cut at a line II-II in FIG. 2B.
Figure 5B:
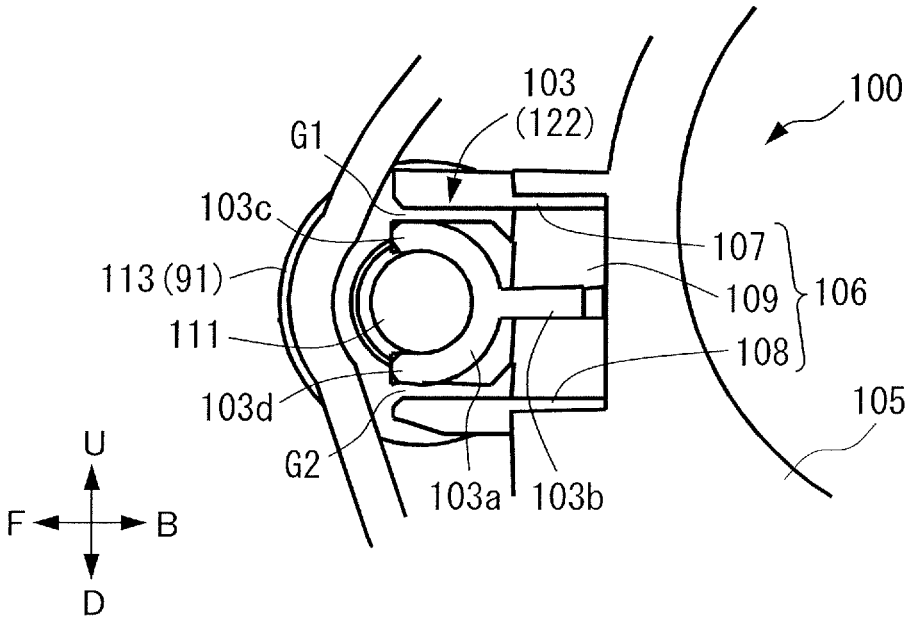
FIG. 5B is a partially enlarged section view of the conveyance driven roller side unit illustrating the state in which the sheet conveyance apparatus of the first embodiment is cut at the line II-II in FIG. 2B.
Figure 6:
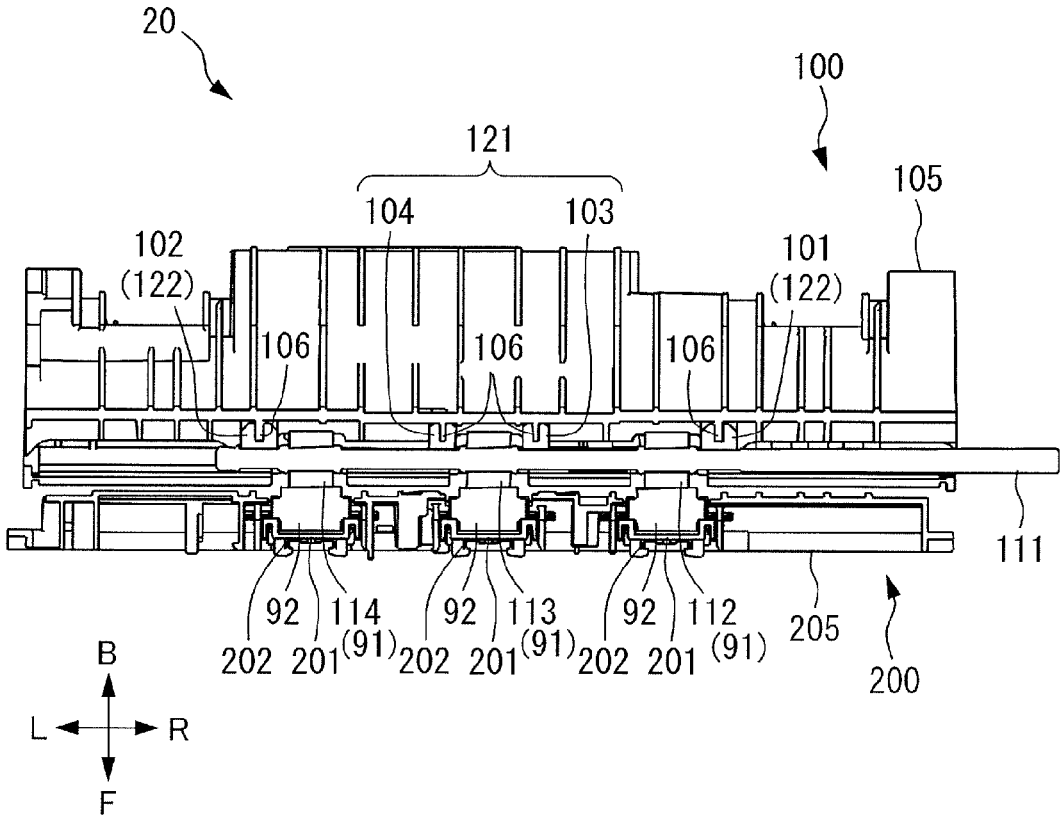
FIG. 6 is a longitudinal section view illustrating a state in which the sheet conveyance apparatus of the first embodiment is cut at a line III-III in FIG. 2B.

Still further, configurations of the conveyance roller side frame 105 and the third bearing 103 will be described with reference to FIGS. 5A and 5B. It is noted that the fourth bearing 104 is configured similarly with the third bearing 103. As illustrated in FIG. 5A, a number of ribs 106 projecting to the front direction F side is formed in the conveyance roller side frame 105 in the same manner with the configuration described above. As illustrated in FIG. 5B, the rib 106 includes an upper restricting portion (restricting portion, restricting member) 107, a lower restricting portion (restricting portion, restricting member) 108, and a rear restricting portion (vertical restricting portion, support portion) 109 also around the third bearing 103. It is noted that although the conveyance driven roller side unit 200 is not illustrated in FIG. 5B, actually the conveyance driven roller side unit 200 is provided, and the conveyance driven rollers 92 abut with and press the respective rollers 112, 113, and 114 in the back direction B. That is, the upper and lower restricting portions 107 and 108, i.e., restricting portions, are provided in a direction along the sheet conveying direction while leaving a predetermined distance from the third and fourth bearings 103 and 104 and are brought into contact with the third and fourth bearings 103 and 104 to restrict the third and fourth bearings 103 and 104 from moving in the direction along the sheet conveying direction. The upper and lower restricting portions 107 and 108 are provided with a predetermined gap from the first bearing portion 121 in the direction along the sheet conveying direction for allowing the first bearing portion 121 to move in a range of the predetermined gap, and configured to restrict the first bearing portion 12 from moving in the direction along the sheet conveying direction in a case when the first bearing portion 121 abuts with the upper and lower restricting portions 107 and 108. Still further, the upper and lower restricting portions 107 and 108, i.e., restricting portions, comprise a pair of restricting members disposed such that the third and fourth bearings 103 and 104 is interposed between the pair of restricting members in the direction along the sheet conveying direction with the predetermined gap from the third and fourth bearings 103 and 104 for allowing the third and fourth bearings 103 and 104 to move in a range of the predetermined gap. The upper and lower restricting portions 107 and 108 are configured to restrict the third and fourth bearings 103 and 104 from moving in the direction along the sheet conveying direction in a case when both end parts, in the direction along the sheet conveying direction, of the third and fourth bearings 103 and 104 abut with the pair of the restricting members 107, 108, respectively.

The upper restricting portion 107 is disposed to the upper direction U side of the third bearing 103 so as to be able to keep a gap G1 and to restrict the third bearing 103 from moving upward further when the gap G1 is zeroed due to the upward move of the third bearing 103. The lower restricting portion 108 is disposed to the lower direction D side of the third bearing 103 so as to be able to keep a gap G2 and to restrict the third bearing 103 from moving downward further when the gap G2 is zeroed due to the downward move of the third bearing 103. The back restricting portion 109 is disposed to the back direction B side of the third bearing 103 to restrict the third bearing 103 from moving to the back side and in the horizontal direction. That is, the conveyance roller side unit 100 includes the upper and lower restricting portions 107 and 108 restricting the third bearing 103 from moving in the vertical direction and the back restricting portion 109 restricting the third bearing 103 from moving in the front-back direction.

The third bearing 103 includes a bearing portion 103*a* formed into an approximately semi-circular arc in section that orients in the front direction F, a holding portion 103*b* projecting to the back direction B side from the bearing portion 103*a*, an upper abutment portion 103*c*, and a lower abutment portion 103*d*. An inner circumferential surface of the bearing portion 103*a* is an approximately semi-circumferential surface and rotatably supports the roller shaft 111 of the conveyance roller portion 91. The holding portion 103*b* projects in the back direction B from the bearing portion 103*a* as a base end so as to bifurcate in the horizontal direction and such that the back restricting portion 109 of the rib 106 is clamped and held between the bifurcated holding portions 103*b* (see FIG. 6). In this state, the holding portion 103*b* is restricted from moving in the horizontal direction and in the back direction by the back restricting portion 109 and is not restricted from moving in the vertical direction by the back restricting portion 109. That is, the back restricting portion 109 supports the third bearing 103 slidably in the direction along the sheet conveying direction. The upper abutment portion 103*c* is abuttable with the upper restricting portion 107 from underneath, and the lower abutment portion 103*d* is abuttable with the lower restricting portion 108 from above. That is, the upper and lower restricting portions 107 and 108 restrict the third bearing 103 from moving in the vertical direction by abutting respectively with both end parts in the vertical direction of the third bearing 103. Still further, the third bearing 103 rotatably supports the roller shaft 111 of the conveyance roller portion 91 with an inner circumferential surface side of the semi-circular tube thereof opened to the sheet conveying surface side, and the both end parts in the direction along the sheet conveying direction are abuttable with the upper and lower restricting portions 107 and 108.

Therefore, the third bearing 103 is restricted from moving in the horizontal direction by the holding portion 103*b* abutting with the back restricting portion 109. Still further, when the conveyance driven roller side unit 200 is assembled to the conveyance roller side unit 100, the second roller 113 is pressed in the back direction B by the conveyance driven roller 92, and the third bearing 103 is pressed in the back direction B by the roller shaft 111. Therefore, the base end part of the holding portion 103*b* is brought into contact with the front end surface of the back restricting portion 109, and the third bearing 103 is restricted from moving in the front-back direction. Here, because there are the gap G1 between the upper abutment portion 103*c* and the upper restricting portion 107 and the gap G2 between the lower abutment portion 103*d* and the lower restricting portion 108, the third bearing 103 is movable in the vertical direction between the upper and lower restricting portions 107 and 108. Thus, the third bearing 103 is provided to be movable within a range restricted by the upper and lower restricting portions 107 and 108, i.e., between the upper and lower restricting portions 107 and 108. Still further, the third and fourth bearings 103 and 104 are supported by the conveyance roller side frame 105 such that a movable range of the third and fourth bearings 103 and 104, with respect to the conveyance roller side unit 100 in the direction along the sheet conveying direction, increases as compared to that of the first and second bearings 101 and 102. Thus, in the present embodiment, the movable range of the third and fourth bearings 103 and 104 with respect to the conveyance roller side unit 100 in the direction along the sheet conveying direction is large as compared to that of the first and second bearings 101 and 102. It is noted that 'the direction along the sheet conveying direction' described in the present specification does not mean only a direction strictly in parallel with the sheet conveying direction, but also means a direction in parallel with the sheet conveying direction including directions approximately in parallel with the sheet conveying direction.

Next, an operation of the sheet conveyance apparatus 20 in the image forming apparatus 1 described above will be described in detail with reference to FIGS. 7A through 9D.

Figure 7A:
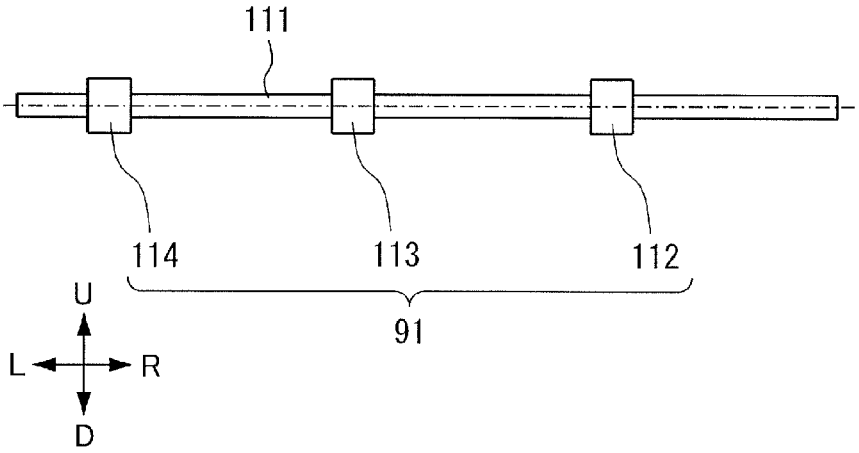
FIG. 7A is a side view of a conveyance roller whose roller shaft is not deflected in the conveyance roller of the first embodiment.
Figure 7B:
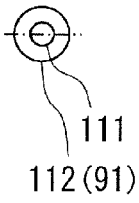
FIG. 7B is a front view of the conveyance roller in FIG. 7A in the conveyance roller of the first embodiment.
Figure 7C:
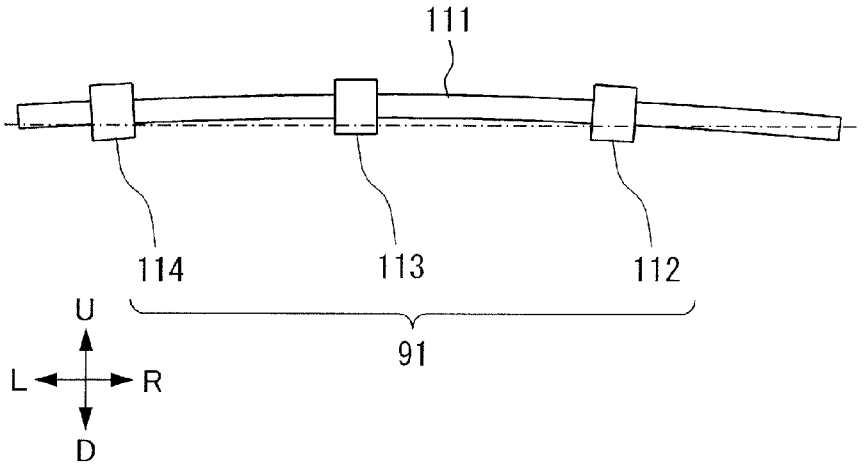
FIG. 7C is a side view of the conveyance roller whose roller shaft is deflected in the conveyance roller of the first embodiment.
Figure 7D:
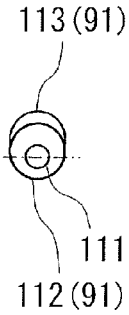
FIG. 7D is a front view of the conveyance roller in FIG. 7C in the conveyance roller of the first embodiment.

Here, the conveyance roller portion 91 will be described with reference to FIGS. 7A through 7D. As illustrated in FIGS. 7A and 7B, an ideal conveyance roller portion 91 includes the roller shaft 111 which is straight and has no deviation at all in terms of an axial center in the longitudinal direction. However, an actual conveyance roller portion 91 includes the roller shaft 111 having a minute deviation in terms of the axial center in the longitudinal direction due to accuracy in molding the component. For instance, as illustrated in FIGS. 7C and 7D, there is a case when the roller shaft 111 of the conveyance roller portion 91 includes a minute deviation in terms of the axial center and a part around a center of the roller shaft is convexed with respect to the axial center around the both end parts of the roller shaft 111. It is noted that the conveyance roller portion 91 illustrated in FIGS. 7C and 7D is exaggerated for convenience of the explanation, and actually the deviation of the axial center is around 0.5 mm at most. An operation of the sheet conveyance apparatus 20 in a case when the conveyance roller portion 91 including the roller shaft 111 having the minute deviation as shown in FIGS. 7C and 7D is applied to the sheet conveyance apparatus 20 will be described below.

In the following description, cases when the conveyance roller portion 91 rotates such that directions in which the second roller 113 of the conveyance roller portion 91 projects change sequentially in the upper direction U, the back direction B, the lower direction D, and the front direction F will be described per each condition with reference to FIGS. 8A through 9D. In these cases, because the positions of the first and second bearings 101 and 102 do not change, the third and fourth bearings 103 and 104 move corresponding to the deflection of the roller shaft 111. Accordingly, while only the third bearing 103 will be described below, the same applies also to the fourth bearing 104. Still further, while the conveyance driven roller side unit 200 is not illustrated in each drawing, actually the conveyance driven roller side unit 200 is provided, and the conveyance driven rollers 92 are in contact with and press the respective rollers 112, 113, and 114 in the back direction B.

Figure 8A:
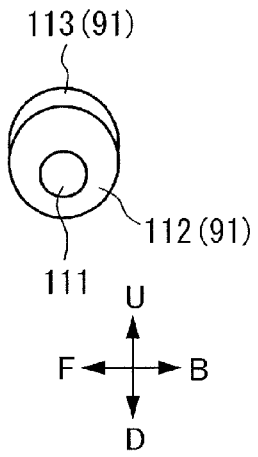
FIG. 8A is a front view of the conveyance roller whose center part projects upward in the sheet conveyance apparatus of the first embodiment.
Figure 8B:
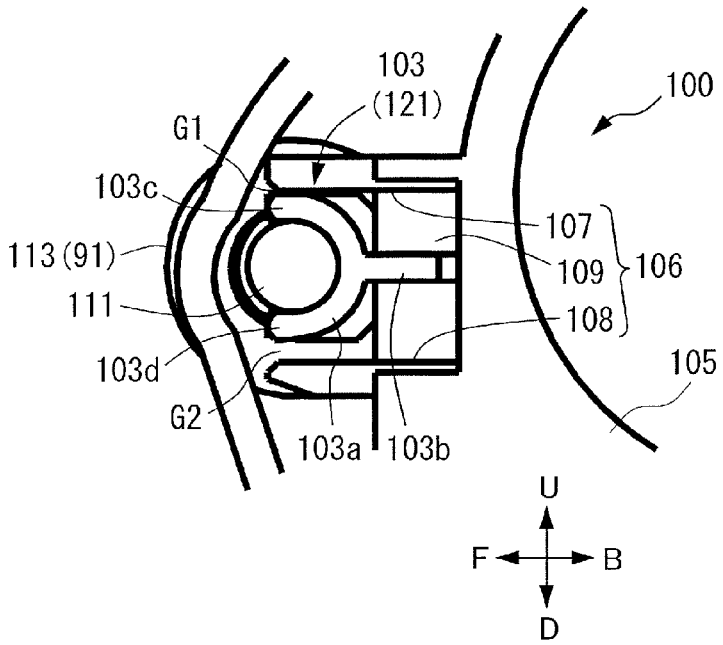
FIG. 8B is a partially enlarged section view illustrating a conveyance driven roller side unit to which the conveyance roller in FIG. 8A is attached in the sheet conveyance apparatus of the first embodiment.

In the case when the direction in which the second roller 113 of the conveyance roller portion 91 projects is the upper direction U as illustrated in FIG. 8A, the third bearing 103 deviates in the upper direction U only by a portion of the deflection of the roller shaft 111 as illustrated in FIG. 8B. If the deflection amount of the roller shaft 111 in the upper direction U is large, the third bearing 103 moves until when the upper abutment portion 103*c* abuts against the upper restricting portion 107 and stops by the abutment. At this time, the gap G1 between the upper abutment portion 103*c* and the upper restricting portion 107 is zeroed, and the gap G2 between the lower abutment portion 103*d* and the lower restricting portion 108 is maximized.

Figure 8C:
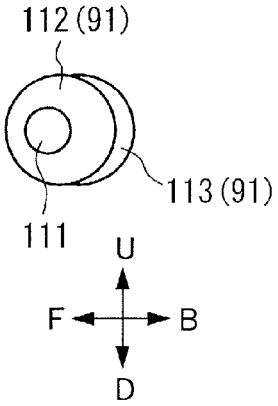
FIG. 8C is a front view of the conveyance roller whose center part projects rearward in the sheet conveyance apparatus of the first embodiment.
Figure 8D:
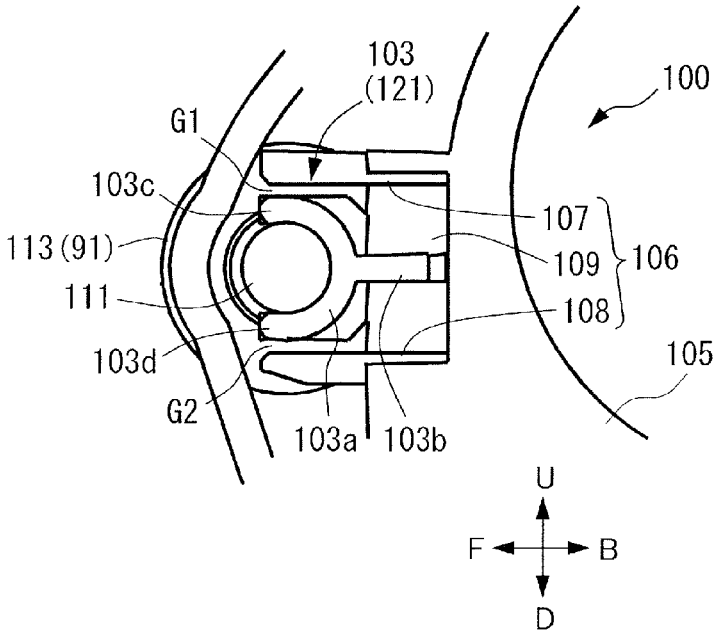
FIG. 8D is a partially enlarged section view of the conveyance driven roller side unit to which the conveyance roller in FIG. 8C is attached in the sheet conveyance apparatus of the first embodiment.

Next, in the case when the direction in which the second roller 113 projects due to the rotation of the conveyance roller portion 91 is the back direction B as illustrated in FIG. 8C, the third bearing 103 does not deviate in the vertical direction and is located at an approximately center part of the upper and lower restricting portions 107 and 108 as illustrated in FIG. 8D. At this time, the conveyance roller side frame 105 receives the pressure from the conveyance driven roller spring 202 through the conveyance roller portion 91 and the third bearing 103. Here, because rigidity of the conveyance roller side frame 105 is stronger than that of the roller shaft 111, the deflection of the roller shaft 111 in the back direction B is corrected in an inverse direction. Accordingly, even if the roller shaft 111 deflects in the back direction B, the third bearing 103 is stopped at a position where the third bearing 103 abuts against the back restricting portion 109.

Figure 9A:
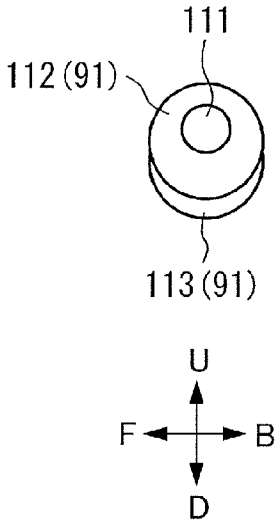
FIG. 9A is a front view of the conveyance roller whose center part projects downward in the sheet conveyance apparatus of the first embodiment.
Figure 9B:
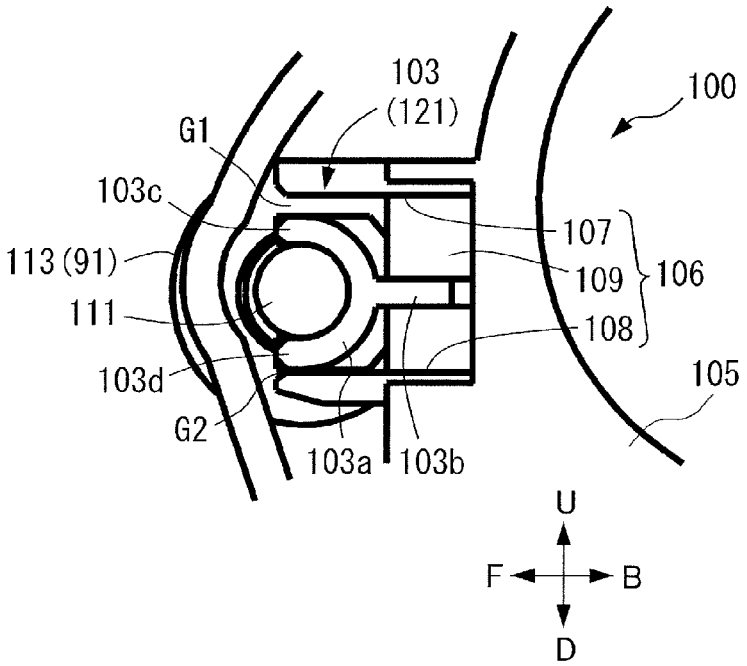
FIG. 9B is a partially enlarged section view of the conveyance driven roller side unit to which the conveyance roller in FIG. 9A is attached in the sheet conveyance apparatus of the first embodiment.

In the case when the direction in which the second roller 113 projects due to the rotation of the conveyance roller portion 91 is the lower direction D as illustrated in FIG. 9A, the third bearing 103 deviates in the lower direction D only by a portion of the deflection of the roller shaft 111 as illustrated in FIG. 9B. If the deflection amount of the roller shaft 111 in the lower direction D is large, the third bearing 103 moves until when the lower abutment portion 103*d* abuts against the lower restricting portion 108 and stops by the abutment. At this time, the gap G1 between the upper abutment portion 103*c* and the upper restricting portion 107 is maximized, and the gap G2 between the lower abutment portion 103*d* and the lower restricting portion 108 is zeroed.

Figure 9C:
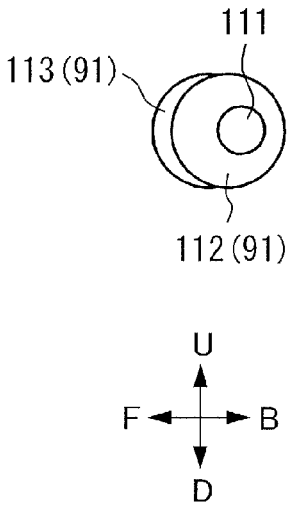
FIG. 9C is a front view of the conveyance roller whose center part projects forward in the sheet conveyance apparatus of the first embodiment.
Figure 9D:
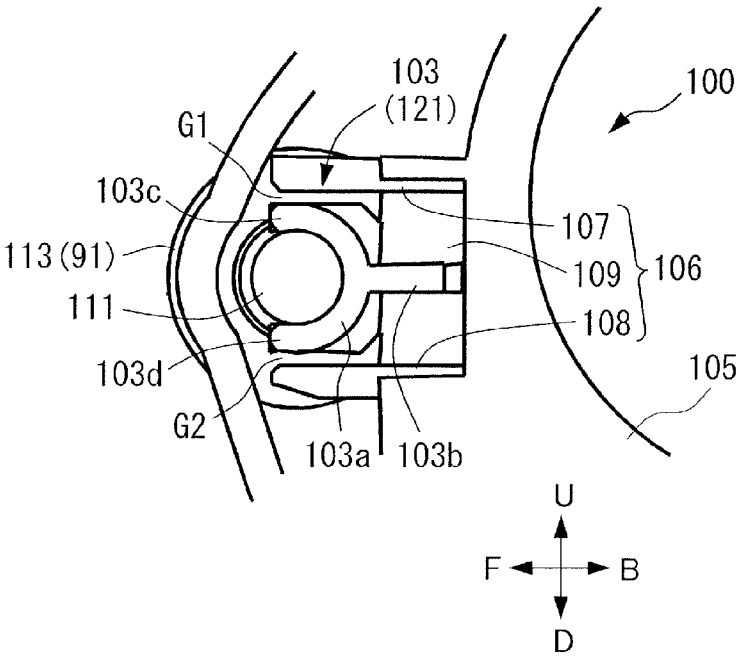
FIG. 9D is a partially enlarged section view of the conveyance driven roller side unit to which the conveyance roller in FIG. 9C is attached in the sheet conveyance apparatus of the first embodiment.

Next, in the case when the direction in which the second roller 113 projects due to the rotation of the conveyance roller portion 91 is the front direction F as illustrated in FIG. 9C, the third bearing 103 does not deviate in the vertical direction and is located at an approximately center part of the upper and lower restricting portions 107 and 108 as illustrated in FIG. 9D. At this time, the conveyance roller side frame 105 receives the pressure from the conveyance driven roller spring 202 through the conveyance roller portion 91 and the third bearing 103. Here, because the rigidity of the conveyance roller side frame 105 is stronger than that of the roller shaft 111, the deflection of the roller shaft 111 in the front direction F is corrected in an opposite direction. Accordingly, even if the roller shaft 111 deflects in the front direction F, the third bearing 103 is stopped at the position where the third bearing 103 abuts against the back restricting portion 109.

Thus, because the third and fourth bearings 103 and 104 are supported movably in the vertical direction, the third and fourth bearings 103 and 104 can move following the deflection even if the roller shaft 111 is rotationally driven while being convexedly deflected.

As described above, according to the image forming apparatus 1 of the present embodiment, the conveyance roller side unit 100 includes the third and fourth bearings 103 and 104 whose movable range with respect to the frame in the vertical direction along the sheet conveying direction is large. Therefore, even if the roller shaft 111 of the conveyance roller portion 91 is not straight and its rotation is eccentric, the third and fourth bearings 103 and 104 move more in the vertical direction as compared to the other bearings 101 and 102. This arrangement makes it possible to permit the eccentricity, to suppress driving torque otherwise from increasing, and to suppress uneven slidability with the bearing and abnormal noise otherwise from being generated. That is, even if the shape of the roller shaft 111 of the conveyance roller portion 91 varies, it is possible to rotationally drive the conveyance roller portion 91 stably.

Still further, according to the image forming apparatus 1 of the present embodiment, because the third and fourth bearings 103 and 104 are disposed between the first and second bearings 101 and 102, position change of the roller shaft 111 can be reduced.

Still further, according to the image forming apparatus 1 of the present embodiment, the first and second bearings 101 and 102 are fixed in the vertical direction with respect to the conveyance roller side unit 100 by the conveyance roller side frame 105. Therefore, because existing configurations can be applied for the first and second bearings 101 and 102, it is preferable from aspects of readiness of designs and of cutting costs of the components.

Still further, according to the image forming apparatus 1 of the present embodiment, the roller shaft 111 is made of a molding material and is formed to be weaker than the conveyance roller side frame 105 in terms of rigidity. Therefore, in the case when the deflecting direction of the roller shaft 111 is the front-back direction, it is possible to readily correct the deflection by pressure of the conveyance driven roller 92 in the back direction B (see FIGS. 8D and 9D) and to maintain the stable rotational drive of the conveyance roller portion 91.

Still further, according to the image forming apparatus 1 of the present embodiment, every one of the upper and lower restricting portions 107 and 108 and the back restricting portion 109 are formed as parts of the rib 106. Therefore, it is possible to provide the respective restricting portions without complicating the configuration while maintaining the rigidity of the conveyance roller side frame 105.

It is noted that while the case where the first and second bearings 101 and 102 are fixed in the vertical direction with respect to the conveyance roller side unit 100 has been described in the image forming apparatus 1 of the present embodiment described above, the present disclosure is not limited to such case. For instance, the first and second bearings 101 and 102 may be disposed so as to be to be movable vertically within a range narrower than that of the third and fourth bearings 103 and 104. Because the third and fourth bearings 103 and 104 move vertically more than the other first and second bearings 101 and 102 also in this case, it is possible to suppress the increase of the driving torque and the generation of the uneven slidability with the bearing and of the abnormal noise even if the roller shaft 111 of the conveyance roller portion 91 is not straight.

Figure 13:
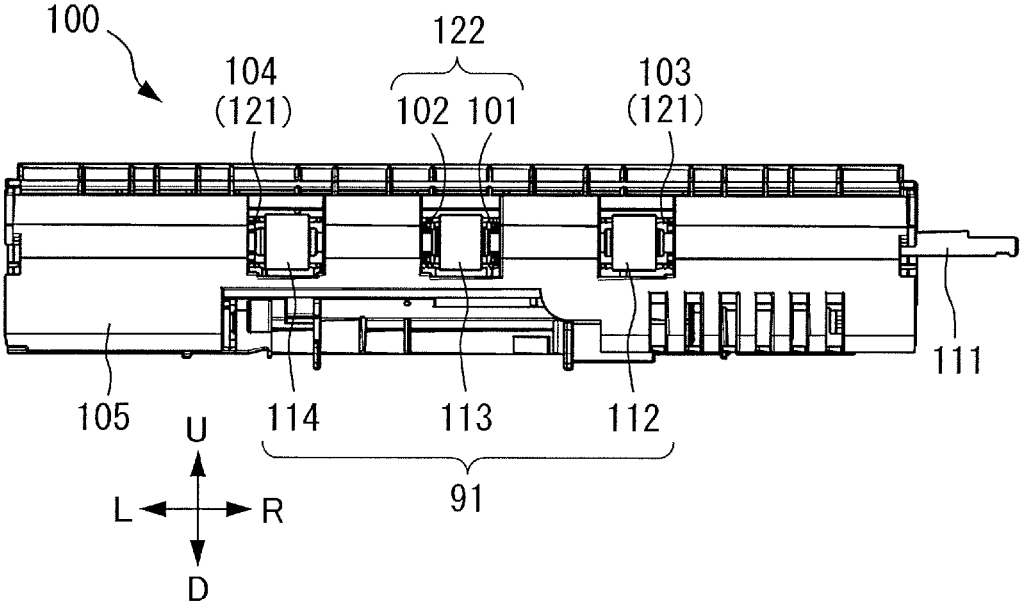
FIG. 13 is a front view illustrating a conveyance roller side unit showing a part of a sheet conveyance apparatus of another embodiment.

Still further, while the case where the third and fourth bearings 103 and 104 are disposed between the first and second bearings 101 and 102 has been described in the image forming apparatus 1 of the present embodiment, the present disclosure is not limited to such case. For instance, as illustrated in FIG. 13, the third and fourth bearings 103 and 104 may be disposed on the outside of the first and second bearings 101 and 102.

Still further, while the case where the restricting portions 107 and 108 are provided at two places in the vertical direction and the third and fourth bearings 103 and 104 are movable vertically between the respective restricting portions 107 and 108 has been described in the image forming apparatus 1 of the present embodiment, the present disclosure is not limited to such case. For instance, it is also possible to configure the bearing and the restricting portion such that projections heading toward the conveyance roller side frame 105 are provided from upper and lower parts of the bearing, and the conveyance roller side frame 105 is provided one restricting projection (a restricting portion) heading toward the bearing. Then, the restricting projection of the conveyance roller side frame 105 is configured to enter between the upper and lower projections of the bearing such that the bearing moves vertically within a range where the upper and lower projections abut with the restricting projection.

Second Embodiment

Next, a second embodiment of the invention will be described in detail with reference to FIGS. 10A through 12D. A configuration of the present embodiment is different from that of the first embodiment in that third and fourth bearings 303 and 304 are supported rotatably centering on a shaft perpendicular to the sheet conveying surface. However, because the configurations of the present embodiment other than that are the same with those of the first embodiment, the same reference numerals denote the same or corresponding components and detailed description thereof will be omitted here.

As illustrated in FIGS. 10A through 12D, a conveyance roller side unit 300 of the present embodiment includes the conveyance roller portion 91, the roller shaft 111, a first bearing portion 321, and a conveyance roller side frame (frame) 305. The first bearing portion 321 comprises the third bearing 303 and the fourth bearing 304. In the present embodiment, the components of the conveyance roller side unit 300 are the same with those of the first embodiment other than the third and fourth bearings 303 and 304 and the conveyance roller side frame 305. Still further, the conveyance roller side unit 300 includes the first and second bearings 101 and 102 in the same manner with the first embodiment (not shown in FIGS. 10A through 12D). The dispositions of the first and second bearings 101 and 102 and of the third and fourth bearings 303 and 304 are the same with those of the first embodiment.

Figure 10A:
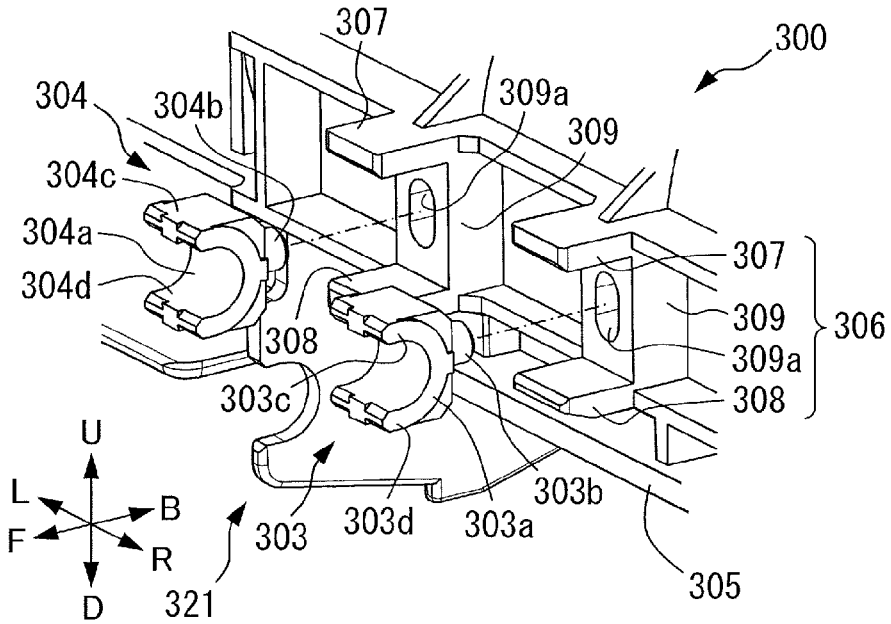
FIG. 10A is a perspective view illustrating a conveyance roller side unit of a sheet conveyance apparatus of a second embodiment in a condition in which a bearing is removed.

As shown in FIG. 10A, the third and fourth bearings 303 and 304 respectively include completely cylindrical fitting bosses (shaft portions) 303*b* and 304*b* projecting in the direction (the back direction B) perpendicular to the sheet conveying surface toward the conveyance roller side frame 305. Still further, the conveyance roller side frame 305 includes a number of ribs 306 formed so as to project to the front direction F side. The rib 306 includes an upper restricting portion (restricting portion, restricting member) 307, a lower restricting portion (restricting portion, restricting member) 308, and a back restricting portion (vertical direction restricting portion, support portion) 309 around the respective bearings 303 and 304.

Still further, the back restricting portion 309 includes vertically long oval fitting holes (hole portion) 309*a* formed at a front end surface of the back restricting portion 309. The fitting bosses 303*b* and 304*b* are formed into complete circle shapes in section, are inserted respectively into the fitting holes 309*a* and are vertically movably and rotatably supported by the fitting holes 309*a*. That is, the conveyance roller side frame 305 has the fitting holes 309*a* supporting the respective fitting bosses 303*b* and 304*b* movably in the direction along the sheet conveying direction and rotatably. That is, the fitting holes 309*a* support the third and fourth bearings 303 and 304 slidably in the direction along the sheet conveying direction. This arrangement makes it possible to support the third and fourth bearings 303 and 304 rotatably centering on the shafts perpendicular to the sheet conveying surface.

Figure 10B:
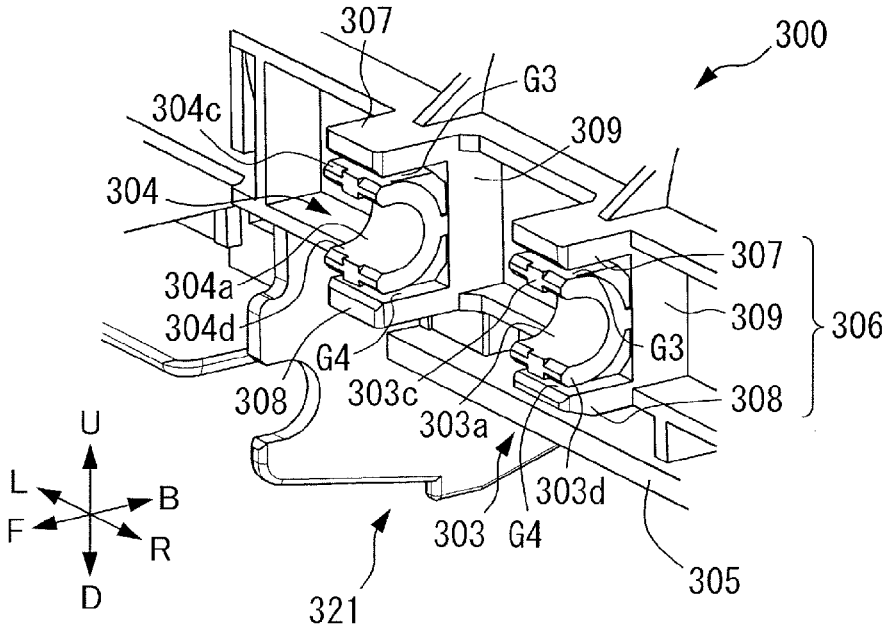
FIG. 10B is a perspective view illustrating a conveyance roller side unit of a sheet conveyance apparatus of a second embodiment in a condition in which a bearing is attached.

Still further, as illustrated in FIG. 10B, the third bearing 303 is attached while keeping a gap G3 from the upper restricting portion 307 and a gap G4 from the lower restricting portion 308. In the same manner with the first embodiment, the third bearing 303 receives the pressure of the conveyance driven roller spring 202 through the conveyance roller portion in the front-back direction and abuts against the back restricting portion 309 of the conveyance roller side frame 305. Still further, because the fitting boss 303*b* is inserted into the fitting hole 309*a* of the conveyance roller side frame 305, the third bearing 303 is fixed with respect to the conveyance roller side frame 305 in terms of the horizontal direction. It is noted that the same configuration applies also to the fourth bearing 304.

In the following description, cases when the conveyance roller portion 91 rotates such that directions in which the second roller 113 of the conveyance roller portion 91 projects change sequentially in the upper direction U, the back direction B, the lower direction D, and the front direction F will be described per each condition with reference to FIGS. 11A through 12D. In these cases, because the positions of the first and second bearings 101 and 102 do not change, the third and fourth bearings 303 and 304 move corresponding to the deflection of the roller shaft 111. Accordingly, while only the third bearing 303 will be described below, the same applies also to the fourth bearing 304. Still further, while the conveyance driven roller side unit 200 is not illustrated in each drawing, actually the conveyance driven roller side unit 200 is provided, and the conveyance driven rollers 92 are in contact with and press the respective rollers 112, 113, and 114 in the back direction B.

Figure 11A:
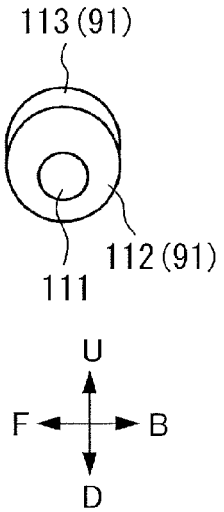
FIG. 11A is a front view of the conveyance roller whose center part projects upward in the sheet conveyance apparatus of the second embodiment.
Figure 11B:
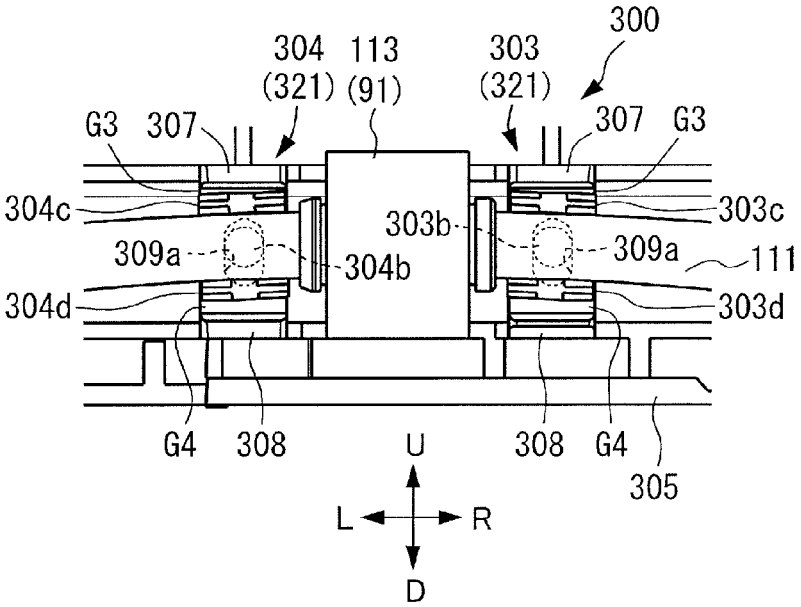
FIG. 11B is a partially enlarged front view of the conveyance roller side unit to which the conveyance roller in FIG. 11A is attached in the sheet conveyance apparatus of the second embodiment.

In the case when the direction in which the second roller 113 of the conveyance roller portion 91 projects is the upper direction U as illustrated in FIG. 11A, the third bearing 303 deviates in the upper direction U only by a portion of the deflection of the roller shaft 111 as illustrated in FIG. 11B. If the deflection amount of the roller shaft 111 in the upper direction U is large, the third bearing 303 moves until when the upper abutment portion 303*c* abuts against the upper restricting portion 307. In the same time, because the third bearing 303 is supported rotatably centering on the shaft of the fitting boss 303*b*, the third bearing 303 stops inclining in contact with the roller shaft 111 deflected in the vertical direction. At this time, the gap G3 between the upper abutment portion 303*c* and the upper restricting portion 307 is minimized (almost zeroed), and the gap G4 between the lower abutment portion 303*d* and the lower restricting portion 308 is maximized.

Figure 11C:
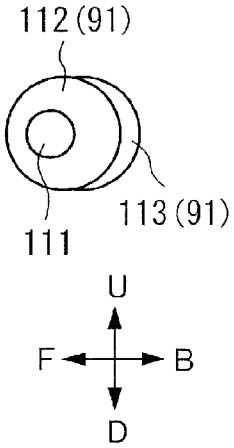
FIG. 11C is a front view of the conveyance roller whose center part projects rearward in the sheet conveyance apparatus of the second embodiment.
Figure 11D:
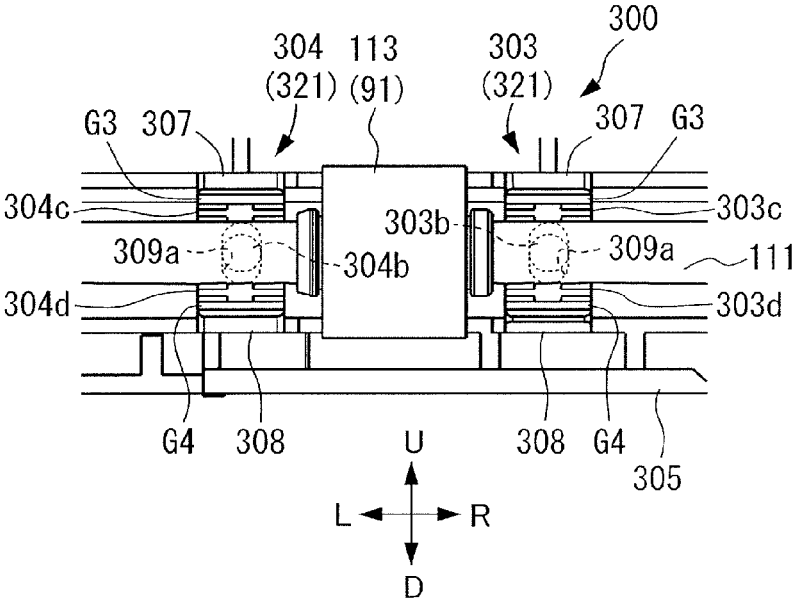
FIG. 11D is a partially enlarged front view of the conveyance roller side unit to which the conveyance roller in FIG. 11C is attached in the sheet conveyance apparatus of the second embodiment.

Next, the case when the direction in which the second roller 113 projects due to the rotation of the conveyance roller portion 91 is the back direction B as illustrated in FIG. 11C will be described. In this case, as illustrated in FIG. 11D, the third bearing 303 does not deviate in the vertical direction and is located at an approximately center part of the upper and lower restricting portions 307 and 308. At this time, the conveyance roller side frame 305 receives the pressure from the conveyance driven roller spring 202 through the conveyance roller portion 91 and the third bearing 303.

Here, because the rigidity of the conveyance roller side frame 305 is stronger than that of the roller shaft 111, the deflection of the roller shaft 111 in the back direction B is corrected in an opposite direction. Accordingly, even if the roller shaft 111 deflects in the back direction B, the third bearing 303 is stopped at a position where the third bearing 303 abuts against the back restricting portion 309.

Figure 12A:
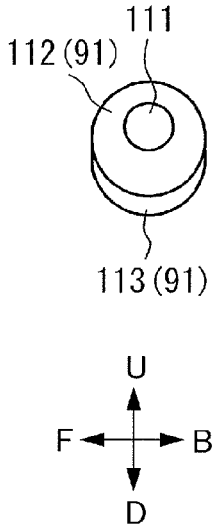
FIG. 12A is a front view of the conveyance roller whose center part projects downward in the sheet conveyance apparatus of the second embodiment.
Figure 12B:
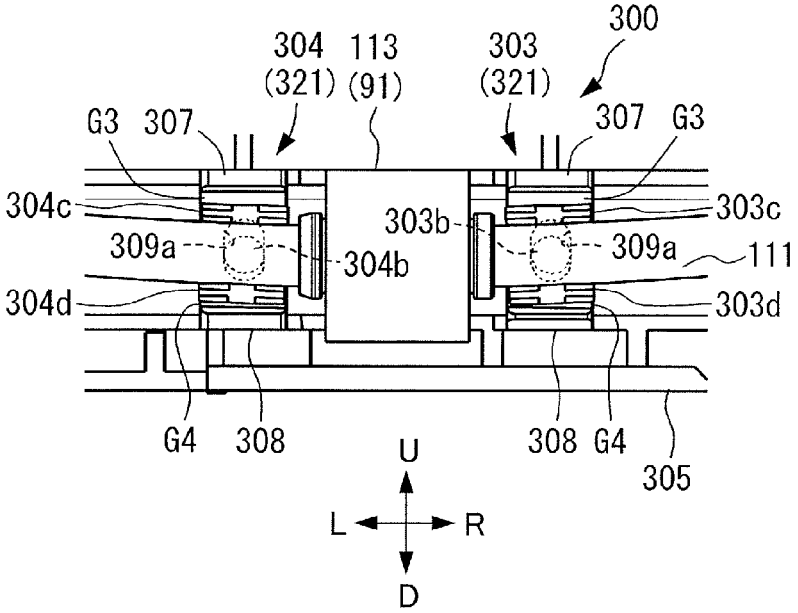
FIG. 12B is a partially enlarged front view of the conveyance roller side unit to which the conveyance roller in FIG. 12A is attached in the sheet conveyance apparatus of the second embodiment.

In the case when the direction in which the second roller 113 projects due to the rotation of the conveyance roller portion 91 is the lower direction D as illustrated in FIG. 12A, the third bearing 303 deviates in the lower direction D only by a portion of the deflection of the roller shaft 111 as illustrated in FIG. 12B. If the deflection amount of the roller shaft 111 in the lower direction D is large, the third bearing 303 moves until when the lower abutment portion 303*d* abuts against the lower restricting portion 308. At the same time, because the third bearing 303 is supported rotatably centering on the shaft of the fitting boss 303*b*, the third bearing 303 stops inclining in contact with the roller shaft 111 deflected in the vertical direction. In this case, the gap G3 between the upper abutment portion 303*c* and the upper restricting portion 307 is maximized, and the gap G4 between the lower abutment portion 303*d* and the lower restricting portion 308 is minimized (almost zeroed).

Figure 12C:
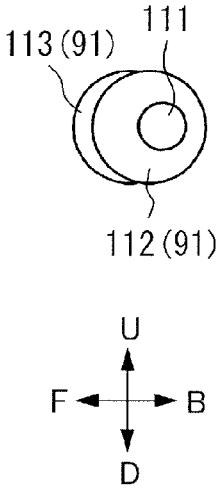
FIG. 12C is a front view of the conveyance roller whose center part projects forward in the sheet conveyance apparatus of the second embodiment.
Figure 12D:
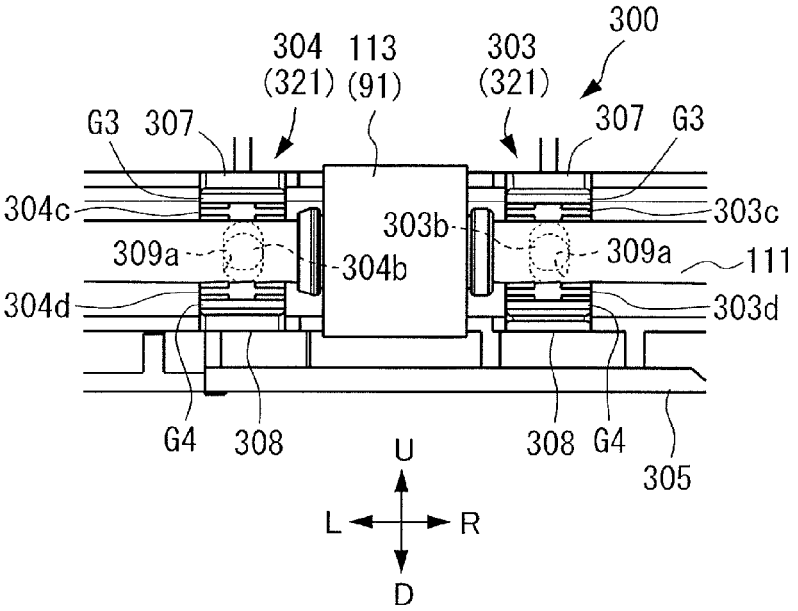
FIG. 12D is a partially enlarged front view of the conveyance roller side unit to which the conveyance roller in FIG. 12C is attached in the sheet conveyance apparatus of the second embodiment.

Next, the case when the direction in which the second roller 113 projects due to the rotation of the conveyance roller portion 91 is the front direction F as illustrated in FIG. 12C will be described. In this case, as illustrated in FIG. 12D, the third bearing 303 does not deviate in the vertical direction and is located at an approximately center part of the upper and lower restricting portions 307 and 308. At this time, the conveyance roller side frame 305 receives the pressure from the conveyance driven roller spring 202 through the conveyance roller portion 91 and the third bearing 303. Here, because the rigidity of the conveyance roller side frame 305 is stronger than that of the roller shaft 111, the deflection of the roller shaft 111 in the front direction F is corrected in an opposite direction. Accordingly, even if the roller shaft 111 deflects in the front direction F, the third bearing 303 is stopped at the position where the third bearing 303 abuts against the back restricting portion 309.

Thus, even if the roller shaft 111 is rotationally driven while being convexedly deflected, the third and fourth bearings 303 and 304 can move following the deflection amount because the third and fourth bearings 303 and 304 are supported movably in the vertical direction and rotatably.

As described above, according to the image forming apparatus 1 of the present embodiment, the conveyance roller side unit 300 includes the third and fourth bearings 303 and 304 whose movable range with respect to the frame in the vertical direction along the sheet conveying direction is large. Therefore, even if the roller shaft 111 of the conveyance roller portion 91 is not straight and its rotation is eccentric, the third and fourth bearings 303 and 304 move more in the vertical direction as compared to the other bearings 101 and 102. This arrangement makes it possible to permit the eccentricity, to suppress driving torque otherwise from increasing, and to suppress uneven slidability and abnormal noise otherwise from being generated.

Still further, according to the image forming apparatus 1 of the present embodiment, the third and fourth bearings 303 and 304 are supported movably in the vertical direction and rotatably centering on the shaft of the fitting bosses 303*b* and 304*b*. Therefore, because the third and fourth bearings 303 and 304 move and rotate following the deflection amount of the roller shaft 111, it is possible to more effectively suppress, as compared to the case when the bearings are not rotated, the driving torque from increasing and the uneven slidability with the bearing and the abnormal noise from being generated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-120241, filed Jun. 15, 2015, which is hereby incorporated by reference herein in its entirety.

What is claimed is:

1. A sheet conveyance apparatus comprising:

a conveyance roller portion conveying a sheet;

a roller shaft supporting the conveyance roller portion;

a first bearing portion and a second bearing portion rotatably supporting the conveyance roller portion;

a frame supporting the first bearing portion and the second bearing portion, the frame supporting the first bearing portion such that a movable amount with respect to the frame, in a direction along a sheet conveying direction, of the first bearing portion is larger than that of the second bearing portion; and a restricting portion provided with a predetermined gap from the first bearing portion in the direction along the sheet conveying direction for allowing the first bearing portion to move in a range of the predetermined gap, and configured to restrict the first bearing portion from moving in the direction along the sheet conveying direction in a case when the first bearing portion abuts with the restricting portion.

2. The sheet conveyance apparatus according to claim 1, wherein the first bearing portion comprises at least one bearing, the second bearing portion comprises at least one bearing, and the first bearing portion and the second bearing portion comprise at least three bearings in total.

3. The sheet conveyance apparatus according to claim 1, wherein the second bearing portion comprises at least two bearings.

4. The sheet conveyance apparatus according to claim 3, wherein the first bearing portion is disposed between the at least two bearings of the second bearing portion.

5. The sheet conveyance apparatus according to claim 1, wherein the first bearing portion comprise at least two bearings, and the at least two bearings are disposed such that the second bearing portion is interposed between the at least two bearings in an axial direction.

6. The sheet conveyance apparatus according to claim 1, wherein the second bearing portion is fixed by the frame in the direction along the sheet conveying direction with respect to the frame.

7. The sheet conveyance apparatus according to claim 1, wherein the first bearing portion comprises at least one bearing, and the frame comprises a support portion supporting the at least one bearing slidably in the direction along the sheet conveying direction.

8. The sheet conveyance apparatus according to claim 7, wherein the restricting portion comprises a pair of restricting members disposed such that the at least one bearing is interposed between the pair of restricting members in the direction along the sheet conveying direction with the predetermined gap from the at least one bearing for allowing the at least one bearing to move in a range of the predetermined gap, and the pair of restricting members is configured to restrict the at least one bearing from moving in the direction along the sheet conveying direction in a case when both end parts, in the direction along the sheet conveying direction, of the at least one bearing abut with the pair of restricting members, respectively.

9. The sheet conveyance apparatus according to claim 8, wherein the at least one bearing is formed into a semi-circular tube which is opened to a sheet conveying surface side and rotatably supports the roller shaft with an inner circumferential side thereof, and wherein the both end parts, in the direction along the sheet conveying direction, of the at least one bearing are abuttable with the pair of restricting members.

10. The sheet conveyance apparatus according to claim 7, wherein the support portion is a rib formed on the frame, and wherein the at least one bearing is supported slidably in the direction along the sheet conveying direction by engaging with the rib.

11. The sheet conveyance apparatus according to claim 7, wherein the support portion is a long hole portion which is long in the direction along the sheet conveying direction, and wherein the at least one bearing is supported slidably in the direction along the sheet conveying direction by being inserted into the hole portion.

12. The sheet conveyance apparatus according to claim 1, wherein the first bearing portion comprises at least one bearing, and the at least one bearing is supported rotatably centering on an axis perpendicular to a sheet conveying surface.

13. The sheet conveyance apparatus according to claim 11, wherein the at least one bearing comprises a shaft portion projecting toward the frame in a direction perpendicular to the sheet conveying surface, and wherein the frame comprises the hole portion supporting the shaft portion movably in the direction along the sheet conveying direction and rotatably.

14. The sheet conveyance apparatus according to claim 1, wherein the conveyance roller portion is one of a plurality of conveyance roller portions.

15. The sheet conveyance apparatus according to claim 1, further comprising a conveyance driven roller pressing the conveyance roller portion with respect to the frame in a direction perpendicular to a sheet conveying surface, wherein the frame comprises a vertical direction restricting portion restricting the first bearing portion from moving in a direction perpendicular to the sheet conveying surface by causing the first bearing portion supporting the conveyance roller portion pressed by the conveyance driven roller to abut with the vertical direction restricting portion.

16. The sheet conveyance apparatus according to claim 1, wherein the roller shaft is made of a molding member whose rigidity is weaker than rigidity of the frame.

17. An image forming apparatus comprising:

the sheet conveyance apparatus according to claim 1; and an image forming portion configured to form an image on a sheet conveyed from the sheet conveyance apparatus.

* * * * *